US007401594B2

(12) United States Patent
Usui et al.

(10) Patent No.: US 7,401,594 B2
(45) Date of Patent: Jul. 22, 2008

(54) DAMPER MECHANISM AND HIGH PRESSURE FUEL PUMP

(75) Inventors: Satoshi Usui, Chiyoda-ku (JP); Minoru Hashida, Chiyoda-ku (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/546,430

(22) Filed: Oct. 12, 2006

(65) Prior Publication Data

US 2007/0079810 A1 Apr. 12, 2007

Related U.S. Application Data

(63) Continuation of application No. 10/896,039, filed on Jul. 22, 2004, now Pat. No. 7,124,738.

(30) Foreign Application Priority Data

Jul. 22, 2003 (JP) ..... 2003-199946

(51) Int. Cl.
*F02M 37/04* (2006.01)

(52) U.S. Cl. ..... 123/467; 123/447

(58) Field of Classification Search ..... 123/467, 123/446, 494, 456, 514; 138/26, 28, 30
See application file for complete search history.

(56) References Cited

U.S. PATENT DOCUMENTS

| | | | | |
|---|---|---|---|---|
| 4,625,694 | A | 12/1986 | Adey et al. | |
| 4,649,884 | A | 3/1987 | Tuckey | |
| 5,617,827 | A * | 4/1997 | Eshleman et al. | 123/456 |
| 5,794,594 | A | 8/1998 | Fehlmann | |
| 6,062,830 | A | 5/2000 | Kikuchi et al. | |
| 6,135,734 | A * | 10/2000 | Isozumi et al. | 417/542 |
| 6,213,094 | B1 * | 4/2001 | Onishi et al. | 123/447 |
| 6,223,725 | B1 | 5/2001 | Onishi et al. | |
| 6,443,131 | B1 * | 9/2002 | Bueser | 123/467 |
| 6,901,912 | B1 | 6/2005 | Onishi et al. | |

(Continued)

FOREIGN PATENT DOCUMENTS

| | | |
|---|---|---|
| EP | 1431570 | 8/2004 |

(Continued)

OTHER PUBLICATIONS

Patent Abstracts of Japan for Japanese Publication No. 10-077927.

(Continued)

*Primary Examiner*—Carl S Miller
(74) *Attorney, Agent, or Firm*—Crowell & Moring LLP

(57) ABSTRACT

To obtain a small and high performance damper mechanism which reduces pressure pulsation in low pressure-side fuel in the high pressure fuel pump in a high pressure fuel supply system or a high pressure fuel pump provided with the small and high performance damper mechanism.

Two metal diaphragms are welded together over the entire circumference to obtain a metal diaphragm assembly (also referred to as "double metal diaphragm damper"). The whole or part of the portion of the metal diaphragm assembly other than the weld (for example, the portion inside the weld) is clamped by a pressing member and thereby the assembly is secured in a housing enclosure. The housing enclosure may be formed integrally with the body of a high pressure pump.

6 Claims, 12 Drawing Sheets

U.S. PATENT DOCUMENTS

| | | | | |
|---|---|---|---|---|
| 7,124,738 | B2 * | 10/2006 | Usui et al. | 123/446 |
| 7,165,534 | B2 * | 1/2007 | Usui et al. | 123/467 |
| 2002/0157646 | A1 * | 10/2002 | Hiraku et al. | 123/456 |
| 2003/0116134 | A1 * | 6/2003 | Kojima | 123/446 |
| 2004/0200456 | A1 * | 10/2004 | Eser et al. | 123/458 |

FOREIGN PATENT DOCUMENTS

| | | |
|---|---|---|
| GB | 1 358 473 | 7/1974 |
| JP | 3180948 | 9/1996 |
| JP | 2000-1831866 | 12/1998 |

OTHER PUBLICATIONS

Patent Abstracts of Japan for Japanese Publication No. 2000-193186.

* cited by examiner

DAMPER MECHANISM AND HIGH PRESSURE FUEL PUMP

RELATED APPLICATIONS

This application is continuation of U.S. patent application Ser. No. 10/896,039, filed Jul. 22, 2004, now U.S. Pat. No. 7,124,738 which claims priority from Japanese application serial no. 2003-199946, filed on Jul. 22, 2003), the contents of each of which are hereby incorporated by reference into this application.

FIELD OF THE INVENTION

The present invention relates to a damper mechanism for reducing fuel pressure pulsation in a high pressure fuel pump which supplies pressurized fuel to the fuel injection valves of an internal combustion engine. It also relates to a high pressure fuel pump provided with such a damper mechanism.

BACKGROUND OF THE INVENTION

As this type of damper mechanism or a high pressure fuel pump provided with the damper mechanism, various dumpers and pumps have been conventionally known. One example is a single metal diaphragm damper and a high pressure fuel pump provided with the single metal diaphragm damper. The single metal diaphragm damper is so constituted that the peripheral portion of a single metal diaphragm is secured in a housing by welding. (Refer to Japanese Patent Laid-Open No. 2000-193186 and Japanese Patent Publication No. 3180948.)

SUMMARY OF THE INVENTION

As mentioned above, the prior art uses a single metal diaphragm, and thus the diameter of the metal diaphragm must be increased to sufficiently reduce pressure pulsation. If two single metal diaphragm dampers are used for the high pressure fuel pump, the fuel pressure pulsation may be reduced without increase in diameter. However, according to such a way, since the plural peripheral portions of the diaphragms are secured in the housing by welding, a large space is required for welding. This results in increase in the size of the damper mechanism or high pressure fuel pump.

The object of the present invention is to provide a small-sized damper mechanism highly effective in the reduction of fuel pressure pulsation or a small-sized high pressure fuel pump provided with the damper mechanism highly effective in the reduction of fuel pressure pulsation.

To attain the above object, the present invention is constituted as follows:

a metal diaphragm assembly (also referred to as "double metal diaphragm damper") is obtained by welding together two metal diaphragms over the entire circumference. The whole or part of the circumference of the metal diaphragm assembly is clamped between retaining members at an area other than the weld (for example, inside the weld) to secure the assembly on a housing.

DESCRIPTION OF THE PREFERRED EMBODIMENTS

Referring to drawings, embodiments of the present invention will be described below.

First Embodiment

Figure 1:
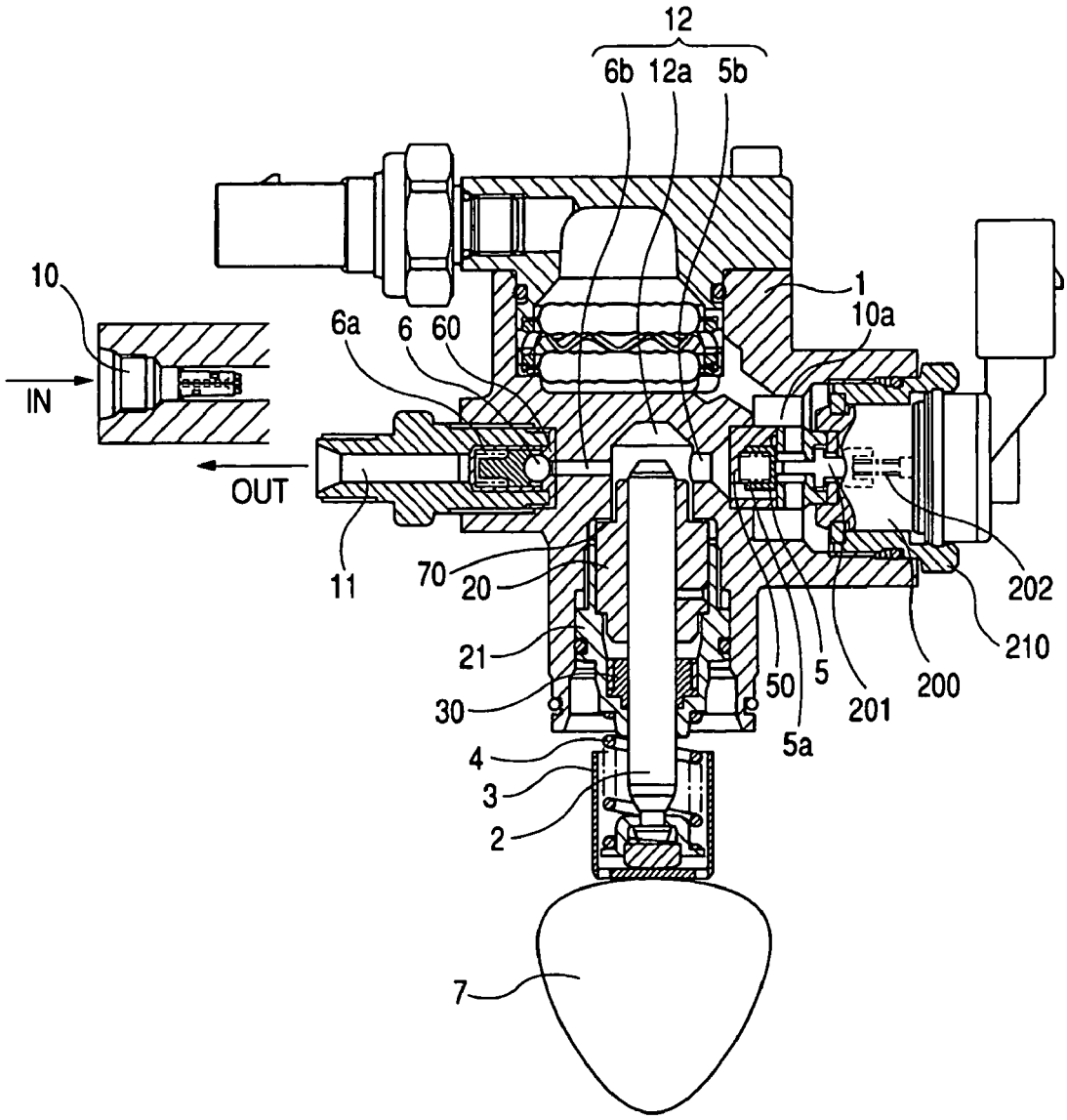
FIG. 1 is a general longitudinal sectional view of a high pressure fuel pump in the first embodiment of the present invention.
Figure 2:
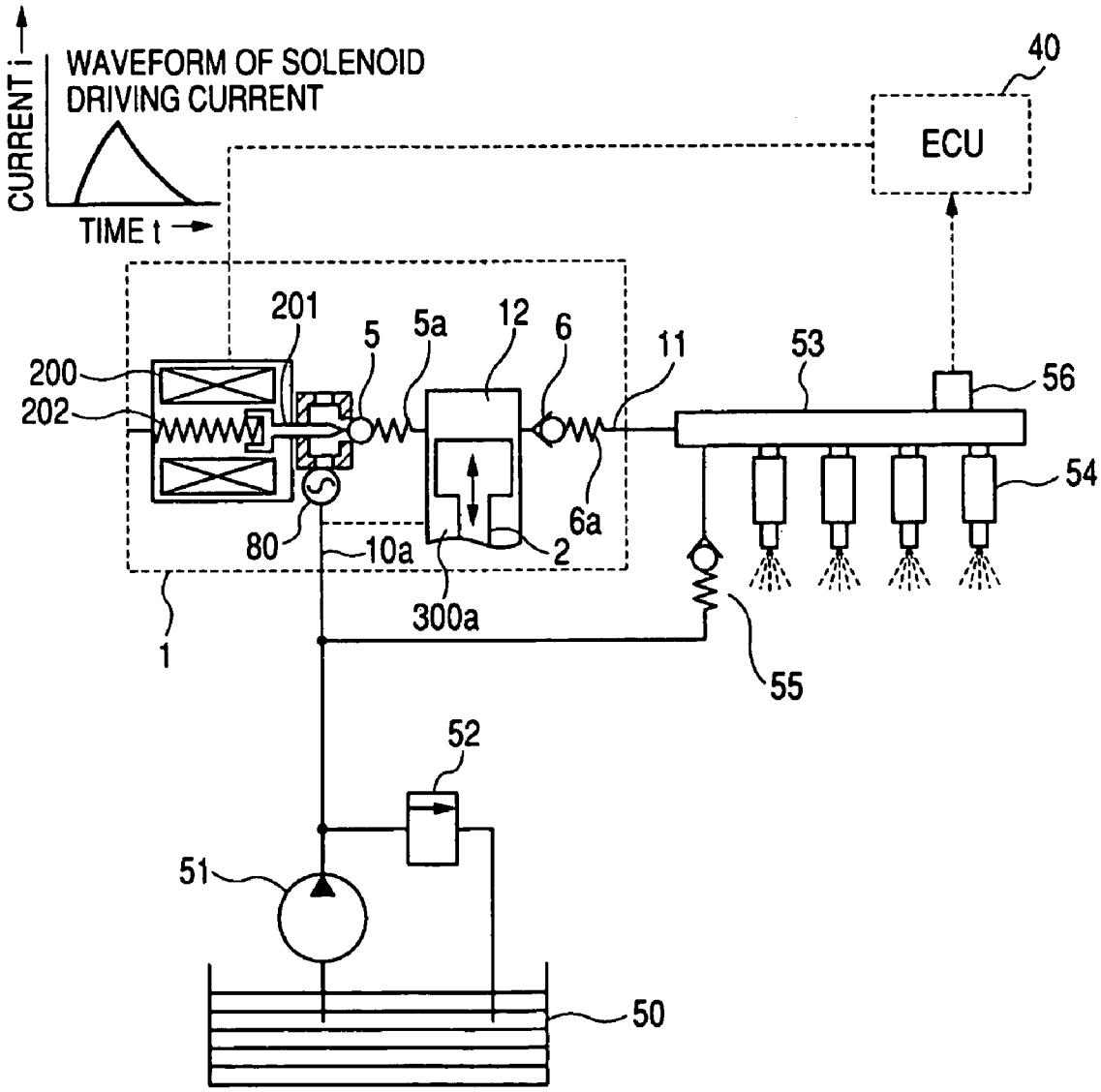
FIG. 2 is a system configuration diagram illustrating an example of a fuel supply system using a high pressure fuel pump to which the present invention is applied.

FIG. 1 is a longitudinal sectional view illustrating the whole of a high pressure fuel pump to which the present invention is applied. FIG. 2 is an overall system diagram illustrating a fuel supply system for internal combustion engine. The figure illustrates a high pressure fuel supply system for use in a direct injection type (cylinder injection type) internal combustion engine.

An intake joint 10 which forms a fuel intake port and a delivery joint 11 which forms a fuel delivery port are screwed to the main body of the pump (also referred to as "pump body") 1. A pressure chamber 12 for pressurizing fuel is formed at a fuel passage between the intake joint 10 and the delivery joint 11.

An intake valve 5 is provided at the inlet of the pressure chamber 12, and a delivery valve 6 is provided at the delivery joint 11. The intake valve 5 and the delivery valve 6 are respectively energized by springs 5*a* and 6*a* in such a direction as to close the intake port and the delivery port of the pressure chamber 12. Thus, these valves constitute so-called check valves that restrict the direction of a fuel flow.

The pressure chamber 12 comprises: a pump chamber 12*a* in which the one end of a plunger 2 as pressurizing member goes and comes with a reciprocal movement; an intake orifice 5*b* leading to the intake valve 5; and a delivery orifice 6*b* leading to the delivery valve 6. The pressure chamber is formed in the pump body 1 by die-cast molding or cutting.

A solenoid 200 is held next to an intake chamber 10*a* in the pump body 1, and an engaging member 201 and a spring 202 are placed in the solenoid 200. When the solenoid 200 is off, energizing force is applied to the engaging member 201 by the spring 202 in such a direction as to open the intake valve 5. The energizing force from the spring 202 is greater than the energizing force from the intake valve spring 5*a*. Therefore, when the solenoid 200 is off, the intake valve 5 is in open state, as illustrated in FIG. 1. Fuel is pumped from a fuel tank 50 to the inlet port of the high pressure pump body 1 by a low pressure pump 51 with its pressure regulated to a constant value by a pressure regulator 52. Thereafter, the fuel is pressurized in the pump body 1, and is fed from the fuel delivery port to the common rail 53. The common rail 53 is mounted with injectors 54, a relief valve 55, and a pressure sensor 56. The number of the injectors 54 mounted is matched with the number of cylinders of the engine, and the injectors 54 carry out injection according to a signal from an engine control unit (ECU) 40. When the pressure in the common rail 53 exceeds a predetermined value, the relief valve 55 is opened to prevent damage to the piping system.

A lifter 3 provided at the lower end of the plunger 2 is contacted to a cam 7 by a spring 4. The plunger 2 is slidably held in a cylinder 20, and is caused to reciprocate by a cam 100 rotated by an engine cam shaft or the like and thereby changes the volume of the pressure chamber 12.

The cylinder 20 is held by a holder 21, and is put in the pump body 1 by screwing a male screw of the holder 21 into the female screw in the pump body 1.

This embodiment is characterized in that the cylinder 20 functions just as a member for slidably holding the plunger 2 and it does not comprise a pressure chamber in itself. This brings the following effects: the cylinder which is made of hard-material hard to machine can be formed in simple shape. Further, only one metal seal 70 between the pump body and the cylinder is sufficient for sealing member.

In the figure, the lower end of the cylinder 20 is sealed with a plunger seal 30, and the blowby of gasoline (fuel) is prevented from leaking out (to the cam 7 side). At the same time, lubricating oil (engine oil can be used for it) which lubricates sliding portions is prevented from leaking into the pressure chamber.

The periphery of the plunger seal 30 is held in the inner circumferential portion of the lower end of the holder 21.

The intake valve 5 is closed in the compression stroke, and the pressure in the pressure chamber 12 is increased. Thereby, the delivery valve 6 automatically opens to feed pressurized fuel into the common rail 53.

The intake valve 5 automatically opens when the pressure in the pressure chamber 12 becomes lower than that of the fuel inlet port. However, its closing operation is determined by the operation of the solenoid 200.

When the solenoid 200 is kept "on" (in energized state), it generates electromagnetic force greater than the energizing force from the spring 202, and attracts the engaging member 201 toward the solenoid 200. As a result, the engaging member 201 is separated from the intake valve 5. In this state, the intake valve 5 functions as an automatic valve which opens and closes in synchronization with the reciprocating motion of the plunger 2. In the compression stroke, therefore, the intake valve 5 is closed, and the fuel equivalent to the reduced volume of the pressure chamber 12 pushes and opens the delivery valve 6, and is fed with the pressure into the common rail 53.

Meanwhile, when the solenoid 200 is kept "OFF" (in unenergized state), the engaging member 201 is engaged with the intake valve 5 by energizing force from the spring 202, and keeps the intake valve 5 in open state. Therefore, even in the compression stroke, the pressure in the pressure chamber 12 is kept at substantially the same low level as the pressure of the fuel inlet port. As a result, the delivery valve 6 cannot be opened, and the fuel equivalent to the reduced volume of the pressure chamber 12 is returned toward the fuel inlet port through the intake valve 5.

If the solenoid 200 is turned on in the middle of the compression stroke, the fuel is pressurized and fed into the common rail 53 from then. Once the feed of the pressurized fuel is started, the pressure in the pressure chamber 12 is increased. Therefore, even if the solenoid 200 is thereafter turned off, the intake valve 5 is kept in closed state, and automatically opens in synchronization with start of the intake stroke.

Therefore, with the reciprocating motion of the plunger 2, three processes of the fuel are repeated as follows: intake of the fuel from the fuel intake joint 10 to the pressure chamber 12; delivery of the fuel from the pressure chamber 12 to the common rail 53; and return of the fuel from the pressure chamber 12 to the fuel intake passage. As a result, fuel pressure pulsation occurs on the low pressure side (intake passage side).

Figure 3:
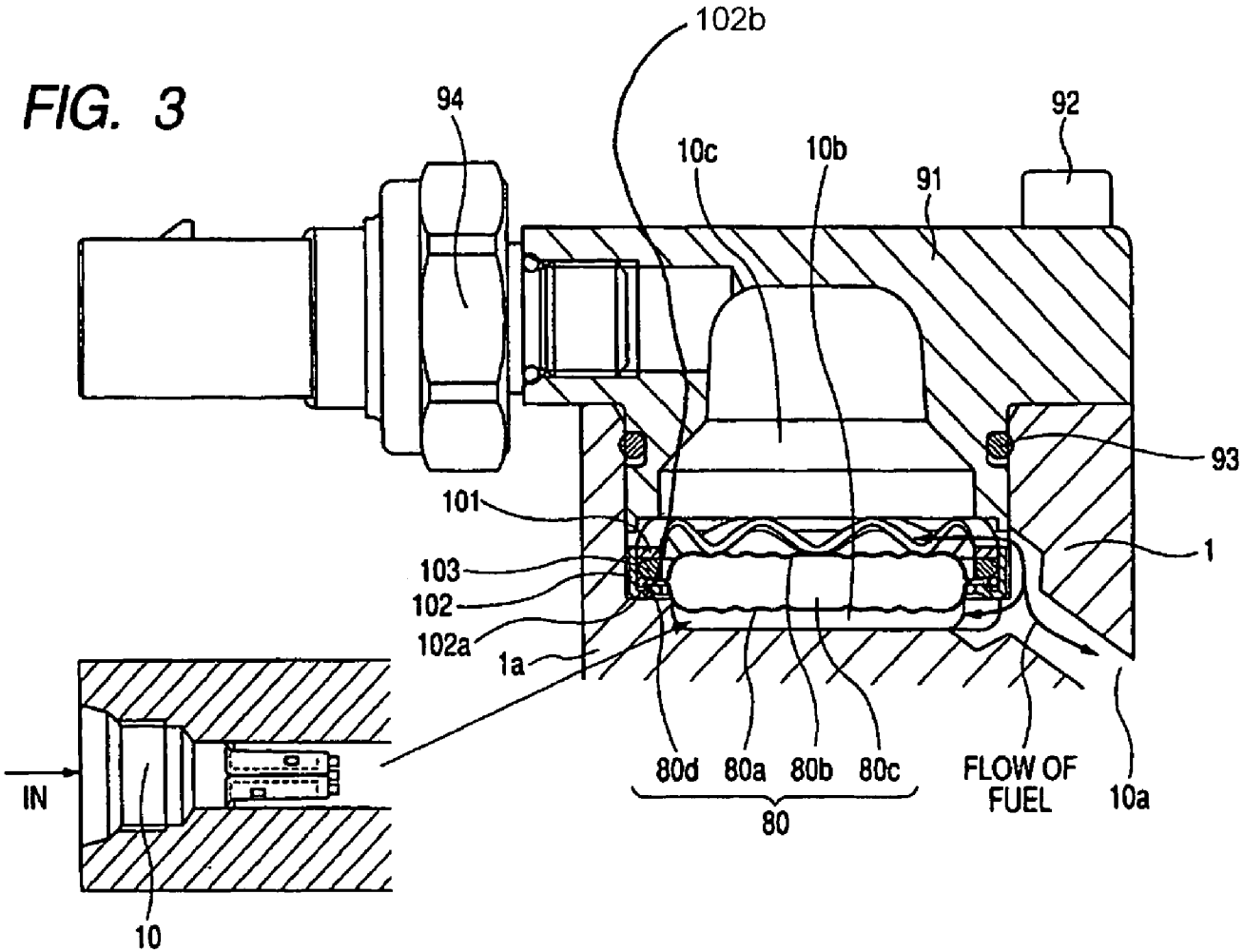
FIG. 3 is a partial longitudinal sectional view of the high pressure fuel pump in the first embodiment of the present invention.

A mechanism for reducing fuel pressure pulsation will be described referring to FIG. 3. FIG. 3 is an enlarged view of the mechanism.

The double metal diaphragm type damper 80 is formed by joining together two diaphragms 80*a* and 80*b*, and by sealing gas 80*c* therein. The double metal diaphragm damper 80 is a pressure sensing element which changes its volume with change in external pressure and thereby performs a function for damping the fuel pulsation. The diaphragm damper 80 is constituted by coaxially joining two circular washbowl-shaped diaphragms made of metal sheet in a state that their concaves face together, and by sealing gas 80*c* in an inner space formed between the two diaphragms. The diaphragms 80*a* and 80*b* have concentric circular crimps of which cross-sectional forms are corrugated shapes so that they easily have elastic deformations under pressure change. The diaphragms 80*a* and 80*b* are joined together by welding their rims over the entire circumference, and the internal gas 80*c* is prevented from leaking by this welding.

In the inner space of the damper 80, the gas 80*c* whose pressure is equal to or greater than the atmospheric pressure is sealed. The pressure of the gas 80*c* can be set at will at manufacturing process of the damper according to the pressure of the fluid to be damped. For example, a mixed gas of argon gas and helium gas is used for the filler gas 80*c*. Helium is easily sensible even if leaking out from a welded portion, and argon is hard to leak out. Therefore, even if the gas 80*c* leaks out at the welded portion, that is sensed easily, and the gas 80*c* is prevented from completely leaking. The composition of the mixture gas is determined so that the leakage is hard to occur and the leakage, if any, can be detected with ease.

The material of the diaphragms 80*a* and 80*b* is precipitation hardened stainless steel that is excellent in corrosion resistance to fuel and in strength. As a mechanism to reduce fuel pressure pulsation, the double metal diaphragm damper 80 is provided between the intake joint 10 and the intake chamber (low pressure chamber) 10*a*.

The double metal diaphragm type damper 80 has the rim clamped between a corrugated washer 101 as corrugated leaf spring and a washer guide 102 over the entire circumference. A washer (annular ring) 103 is used as member for retaining the rim of the damper 80, and is inserted inside of the washer guide 102. The washer 103 is provided with the same chamfers on the outer diameter sides of its both sides. The washer

103 is machined so that its diameter is same as the diameter of the rim of the double metal diaphragm damper 80. The washer guide 102 is provided with an annular groove 102*a* outside the portion clamping the double metal diaphragm damper 80 and an annular shelf 102*b* for limiting the position of the damper in a radial direction.

Thus, when the double metal diaphragm damper 80 and the washer 103 are set inside the washer guide 102, they are guided by the same face of the inside wall of the washer guide 102. The periphery weld 80*d* of the damper 80 is not clamped because it is placed between one chamfer of the washer 103 and the groove 102*a* of the washer guide 102. Therefore, the double metal diaphragm damper is prevented from being damaged due to stress concentration of the clamping.

The washer 103 does not have distinction of the both sides because the both sides have the same chamfers. Thereby, mistake at the time of attachment of the washer 103 can be prevented, and the assembly of parts can be improved.

The clamping force to damper 80 is given by a damper cover 91 through the wave washer (spring washer) 101. The damper cover 91 is fixed on the pump body 1 with a setscrew 92.

Thus, by appropriately selecting the spring constant of the spring washer 101, the rim of the double metal diaphragm damper can be uniformly clamped under appropriate force over the entire circumference.

Further, fuel chambers 10*b* and 10*c*, which are also used for a housing of the metal diaphragm assembly (damper) 80, are connected to the intake chamber (fuel chamber) 10*a* leading to the intake orifice 5*b* of the pressure chamber 12. The fuel chamber 10*b* and 10*c* are sealed with an O-ring 93.

The spring washer 101 has gaps formed by its corrugated surface, and fuel freely comes and goes to the inside of the washer 101 and the fuel chambers 10*b*, 10*c*. Thereby, as the fuel can reach to both sides of the double metal diaphragm damper, fuel pressure pulsation of the pump can be absorbed with efficiency.

A fuel pressure sensor 94 is installed at the damper cover.

According to the embodiment, even if the breakage of the double metal diaphragm damper 80 occurs, it can be sensed easily with the sensor 94.

Second Embodiment

Figure 4:
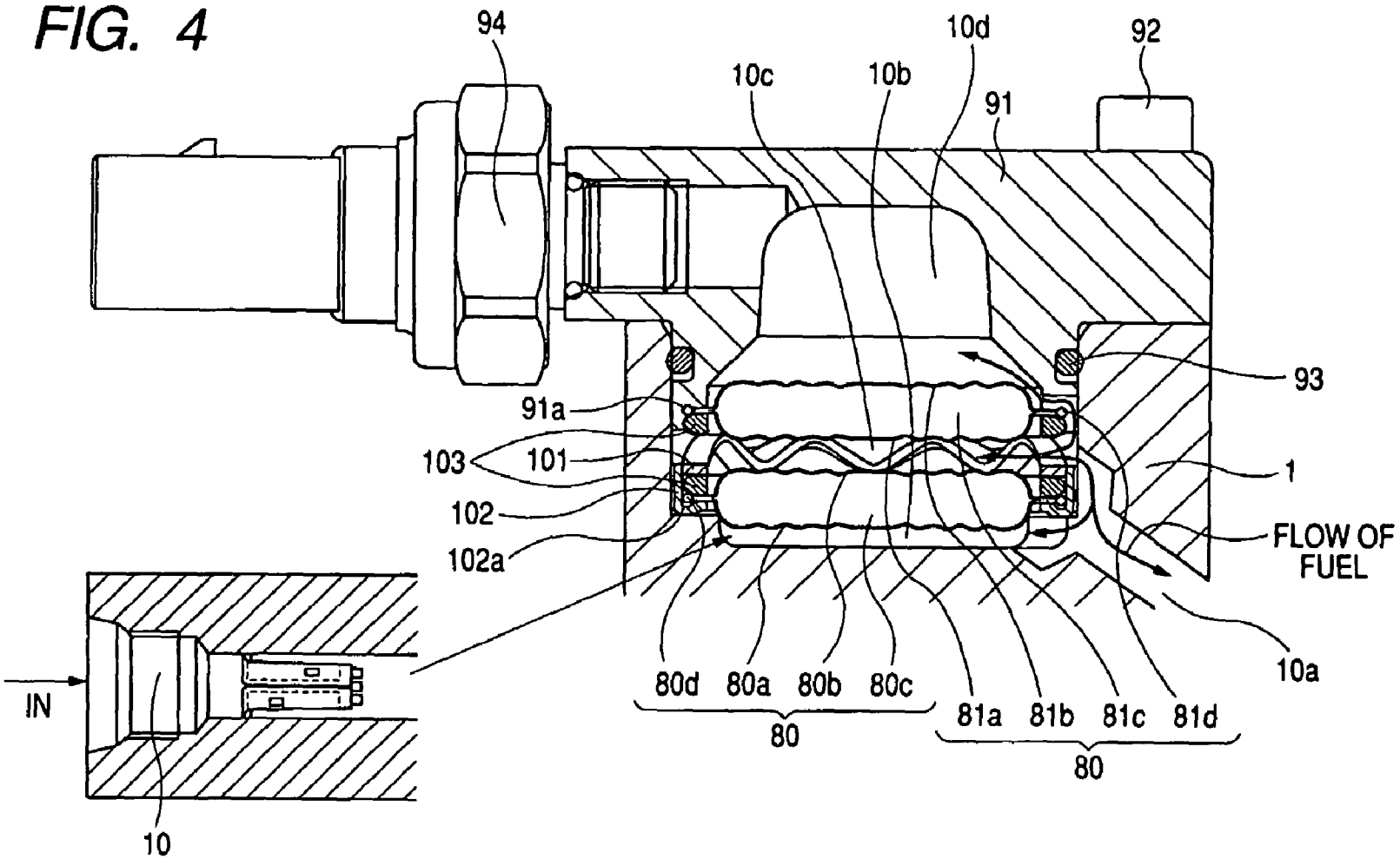
FIG. 4 is a partial longitudinal sectional view of a high pressure fuel pump in the third embodiment of the present invention.

Next, another embodiment of the present invention will be described referring to FIG. 4.

In this embodiment, as a mechanism for reducing fuel pressure pulsation, two double metal diaphragm dampers 80 and 81 are provided at a fuel passage between the intake joint 10 and the intake chamber (low pressure chamber) 10*a*.

The double metal diaphragm damper 80 has its rim clamped between the washer 103 and the washer guide 102 over the entire circumference like the first embodiment. The washer 103 is provided with the same chamfers on the outer diameter sides of its both sides. The washer 103 is machined so that its diameter is same as the diameter of the rim of the double metal diaphragm damper 80. The washer guide 102 is provided with an annular groove 102*a*. The fuel chambers 10*b* and 10*c* are connected to the fuel chamber (intake chamber) 10*a*.

The double metal diaphragm damper 81 has the rim clamped between the washer 103 and the damper cover 91. The damper cover 91 is provided with an annular groove 91*a*. A part of the damper cover 91 clamping the double metal diaphragm damper 81 is also provided with a groove as fuel passage.

A spring washer (a corrugated washer) 101 is provided between two washers 103. Force for clamping the two double metal diaphragm type dampers 80 and 81 are provided by the damper cover 91 through the spring washer 101. The fuel chamber 10*b*, 10*b* and 10*c* are sealed with an O-ring 93.

When two double metal diaphragm damper 80, 81 and two washers 103 are set, the damper 80 and one washer 103 are guided by the same inside of the washer guide 102 like the first embodiment, and the damper 81 and another washer 103 are guided by the same inside of the damper cover 91. The peripheral weld 80*d*, 81*d* of the damper 80, 81 are not clamped, because the weld 80*d* is placed between the chamfer of one washer 103 and the groove 102*a* of the washer guide 102, and the weld 81*d* is placed between the chamfer of another washer 103 and the groove 91*a* of the damper cover 91. Therefore, two double metal diaphragm type damper 80 and 81 are prevented from being damaged due to stress concentration of the clamping.

The spring washer 101 has gaps formed by its corrugated surface, and fuel freely comes and goes to the inside of the washer 101 and the fuel chambers 10*b*, 10*c*. Further the fuel can comes and goes to the fuel chamber 110*d* through the groove formed in the damper cover 91. Therefore, the fuel can be reach to both sides of the two double metal diaphragm dampers 80 and 81, and fuel pressure pulsation can be absorbed with efficiency.

The washer 103 does not have distinction of the both sides. Thereby, mistake at the time of attachment of the washer 103 can be prevented, and the assembly of parts can be improved.

Further, as mentioned above, two double metal diaphragm dampers are provided. Therefore, a high pressure fuel pump wherein the weight and size can be reduced and yet fuel pressure pulsation can be sufficiently absorbed is obtained.

Third Embodiment

Figure 5:
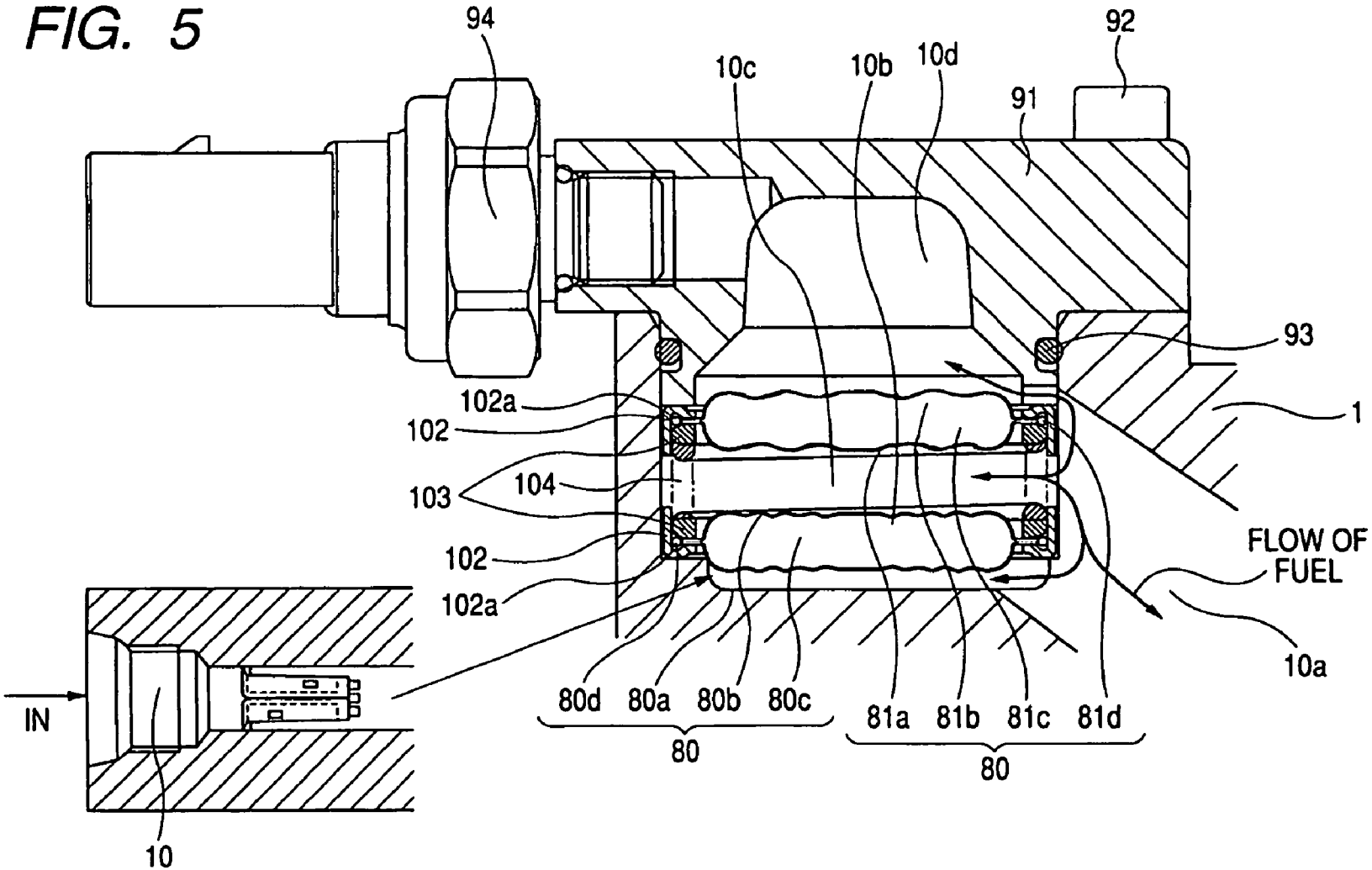
FIG. 5 is a partial longitudinal sectional view of a high pressure fuel pump in the fourth embodiment of the present invention.

Next, a further embodiment of the present invention will be described referring to FIG. 5.

As a mechanism to reduce fuel pressure pulsation, two double metal diaphragm dampers 80 and 81 are provided between the fuel passage 10 and the low pressure chamber 10*a*. The metal diaphragm dampers 80 and 81 are different from each other in cross-sectional shape.

The two double metal diaphragm dampers 80 and 81 have their rims clamped between each washer 103 and each washer guide 102 over the entire circumference. The washers 103 are provided with the same chamfers on the outer diameter sides of its both sides. The rims of the washers 103 are machined to the same dimensions as the rims of the double metal diaphragm dampers 80 and 81. The washer guides 102 are provided with each annular groove 102*a*. Further, the fuel chambers 10*b*, 10*c*, and 10*d* are connected to the fuel chamber (intake chamber) 10*a*.

A spring 104 is provided between the two washers 103. Force for clamping the two double metal diaphragm dampers 80 and 81 are produced by the damper cover 91 through the spring 104. The fuel chambers 10*b*, 10*d* and 10*c* are sealed from the outside by the O-ring 93.

Thus, the two double metal diaphragm dampers 80 and 81 are guided by the same inside face as the washers 103. As the peripheral welds 80*d* or 81*d* are not clamped, the double metal diaphragm dampers 80 and 81 are prevented from being damaged due to stress concentration.

The fuel can enter the fuel chambers 10*b*, 10*c* and 10*d* like above-mentioned embodiments. Therefore, the fuel can reach to both sides of the two double metal diaphragm dampers 80 and 81, and fuel pressure pulsation can be absorbed with efficiency.

Double metal diaphragm dampers are varied in the capability of absorbing fuel pressure pulsation and frequency characteristic according to their cross-sectional shape. As mentioned above, the two double metal diaphragm dampers 80 and 81 are different from each other in cross-sectional shape. Therefore, by appropriately selecting their respective cross-sectional shape, a high pressure fuel pump having the optimum capability of absorbing fuel pressure pulsation is obtained. The two double metal diaphragm dampers may be identical with each other in cross-sectional shape.

Fourth Embodiment

Next, a further embodiment of the present invention will be described referring to FIG. 6. In the embodiment illustrated in FIG. 6, the above-mentioned pressure pulsation damping portion using the double metal diaphragm 80 is separated from the pump and is constituted as an independent pressure pulsation damping mechanism.

Description will be given to such a type that a double metal diaphragm is clamped and secured by swaging a casing made of rolled steel which is easy to manufacture.

Since the pressure pulsation damping mechanism is separated, it can be installed at any point in the fuel system. Therefore, the advantage of excellence in ease of layout is brought. For example, the pressure pulsation damping mechanism can be installed in any part of the main body 1 of the pump or at any point in the fuel piping.

More specific description will be given. The damping characteristic of the pressure pulsation greatly varies depending on the position of installation of the pressure pulsation damping mechanism as well. Therefore, the capability of arbitrarily setting the position of installation is a great advantage in obtaining desired damping characteristic of pressure pulsation.

Further, some fuel supply systems can be different in damping characteristic of the pressure pulsation even if they use the same pump. If several pressure pulsation damping mechanisms are prepared, the desired capability of damping pressure pulsation is obtained in a plurality of fuel supply systems.

Further, use of a metal diaphragm as a separate pressure pulsation damping mechanism provides resistance to substandard fuel. The metal diaphragm can endure great fluctuation in fuel pressure as compared with conventional rubber diaphragms.

The embodiment illustrated in FIG. 6 will be specifically described below.

The pressure pulsation damping mechanism of the present invention comprises: a double metal diaphragm damper 80 which changes its volume according to change in external pressure; a casing 300 which supports the double metal diaphragm damper and constitutes the appearance of the damping mechanism; a cover 310 which holds the double metal diaphragm damper 80 in cooperation with the casing 300; a flange 320 for fastening on a component in which a fluid whose pressure pulsation is to be damped exists; and a connecting tube 330 which has a passage for guiding the fluid whose pressure pulsation is to be damped into the pressure pulsation damping mechanism, and is provided with a function of sealing between the pressure pulsation damping mechanism and the component in which the fluid whose pressure pulsation is to be damped exists.

The casing will be described referring to FIG. 6 and FIG. 7.

The casing 300 supports the double metal diaphragm damper 80, and is provided with the flange 320 for fastening on the component 340 in which the fluid 360 whose pressure pulsation is to be damped exits. The casing 300 forms: the passage 331 for guiding the fluid 360 whose pressure pulsation is to be damped into the pressure pulsation damping mechanism; and a first space 351 for causing the fluid 360 to act on the double metal diaphragm damper 80.

As portions for supporting the double metal diaphragm damper 80, arc-shaped projections 302 forming a circular are provided on the supporting basal plane 301 of the casing 300 in the same pitch. The outer diameter of a circle formed by arc-shaped projections 302, which are in contact with the double metal diaphragm damper 80, is shown as $\Phi D_{302}$. The inside diameter of the weld bead portion 80*c* located at the outermost diameter of the double metal diaphragm damper 80 is shown as $\Phi d_{80c}$. The outside diameter $\Phi D_{302}$ is made smaller than the inside diameter $\Phi d_{80c}$. That is, $\Phi D_{302}<\Phi d_{80c}$. This is for preventing the projections 302 from contacting with the weld bead portion 80*c*.

Figure 7:
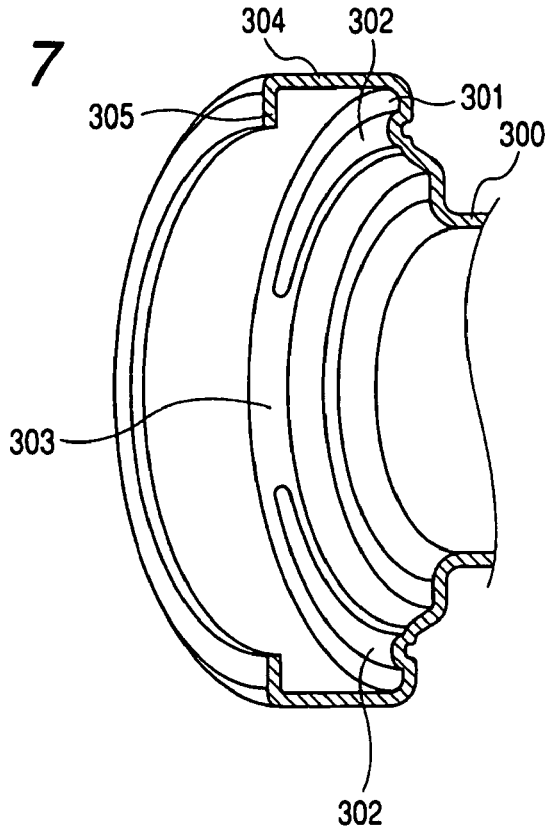
FIG. 7 is an enlarged sectional view illustrating an enlarged portion of the housing.

The portions of the supporting basal plane 301 wherein the arc-shaped projections 302 are not provided, which are portions between the projections 302, are used as fluid passages 303 between a first space 351 and a second space 352 (FIG. 7).

The casing 300 has a cylindrical portion 304 for enclosing the cover 310. The cylindrical portion 304 is coaxial with the arc-shaped projections 302. Using the inner face of the cylindrical portion 304 as a guide of the cover 310, the cover 310 is coaxially installed and held inside the cylindrical portion 304.

With ease of molding, strength, and corrosion resistance taken into account, an alloy-plated rolled steel plate is used for the material of the casing 300 though the material is not limited to this.

The cover 310 as a lid will be described in detail referring to FIG. 6 and FIG. 8.

The cover 310 constitutes the appearance of the damper together with the casing 300. The double metal diaphragm damper 80 is coaxially placed on the arc-shaped projections 302 of the casing 300 in contact therewith. The cover 310 presses down the damper 80 from the direction opposite to the first space 351 and holds the damper 80 in cooperation with the projections. Thus, the cover 310 forms the second space 352 on the opposite side to the first space 351 with respect to the double metal diaphragm damper 80.

Like the casing 300, the cover 310 is provided with the ark-shaped projections 312 for supporting the double metal diaphragm 80, that is, for holding the damper 80 in cooperation with the casing. The outside diameter of a circle formed by ark-shaped projections 312, which are in contact with the double metal diaphragm damper 80, is shown as $\Phi D_{312}$. The inside diameter of the weld bead portion 80*c* located at the outermost diameter of the double metal diaphragm damper 80 is shown as $\Phi d_{80c}$. The outside diameter $\Phi D_{312}$ is made smaller than the inside diameter $\Phi d_{80c}$. That is, $\Phi D_{312}<\Phi d_{80c}$. This is for preventing the projections 312 from contacting with the weld bead portion 80*c*.

Figure 8:
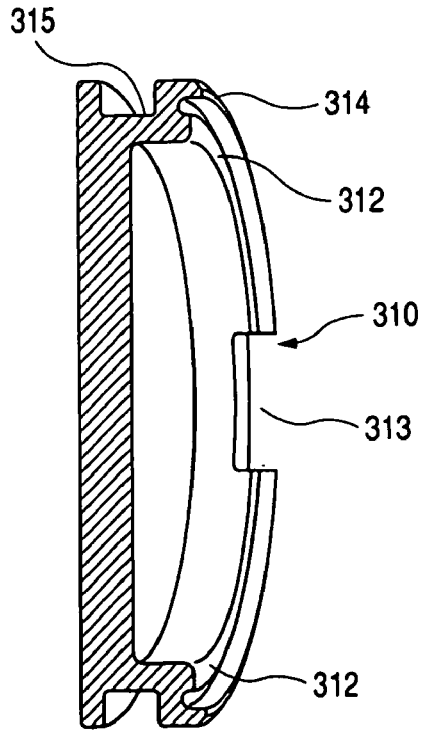
FIG. 8 is an enlarged sectional view illustrating an enlarged portion of the housing.

In the same way as the casing, the portions wherein the arc-shaped projections 312 are not provided, which are portions between the projections 312, are used as a passage 313 for fluid passage between the first space 351 and the second space 352 (FIG. 8).

The cover is provided with a guide 314 outside the arc-shaped projections. The guide 314 supports the double metal diaphragm 80 by contacting with that. The position of the double metal diaphragm 80 in the radial direction is limited by the guide 314. Because of the limited position of the double metal diaphragm 80 and the above-mentioned relation expressed as $\Phi D_{302}<\Phi d_{80c}$ and $\Phi D_{312}<\Phi d_{80c}$, the weld bead portion 80*d* of the double metal diaphragm 80 is so structured that it is completely free of the supporting portions.

As the passage 313 for connecting the first space 351 and the second space 352, the guide 314 is also cut. That is, the portion which is cut and is thus not used as the guide is taken as the fluid passage 313, together with the portions wherein the projections 312 are not provided (the cut portions of an annular projection formed by the ark-shaped projections 312).

An O-ring 370 is provided on the rim of the cover 310 for the prevention of fuel leakage to the outside. The O-ring is confined by a groove 315 formed in the cover 310 and the cylindrical portion 304 of the casing 300. The cover 310 is secured together with the double metal diaphragm 80 by plastically deforming and folding the end 305 of the casing.

With strength and corrosion resistance taken into account, stainless steel is used for the material of the cover 310 though the material is not limited to this.

The connecting tube 330 and the fastening flange 320 will be described referring to FIG. 6.

The connecting tube 330 is a tube for guiding a fluid from a component 340 (e.g. pump and pipe) wherein the fluid whose pressure pulsation is to be damped exists into the first space 351 in the pressure pulsation damping mechanism. The connecting tube 330 is inserted to the component 340 wherein the fluid whose pressure pulsation is to be damped exists and is joined with the component 340. An O-ring 371 is installed on the rim of the connecting tube for sealing the fluid between it and the component 340.

Plated steel is used for the material of the connecting tube 330 though the material is not limited to this. Further, fuel resistant fluororubber, more particularly, ternary fluororubber or the like, not unitary or binary, is used for the material of the O-rings 370 and 371.

The fastening flange 320 is disposed so as to be held between the casing 300 and the connecting tube 330. To be fastened onto the flat portion of the component 340, the fastening flange 300 is in plate shape and is provided with one or two holes 321 for screw cramp.

Plated rolled steel is used for the material of the fastening flange 330 though the material is not limited to this.

The component 340 is provided with a hole 341 for inserting the connecting tube 330 and the screw hole 321 for fastening. The pressure pulsation damping mechanism is installed as follows: the connecting tube 330 with the O-ring as a sealing mechanism is inserted into the hole 341, and a screw 380 is tightened through the fastening flange 320.

Figure 6:
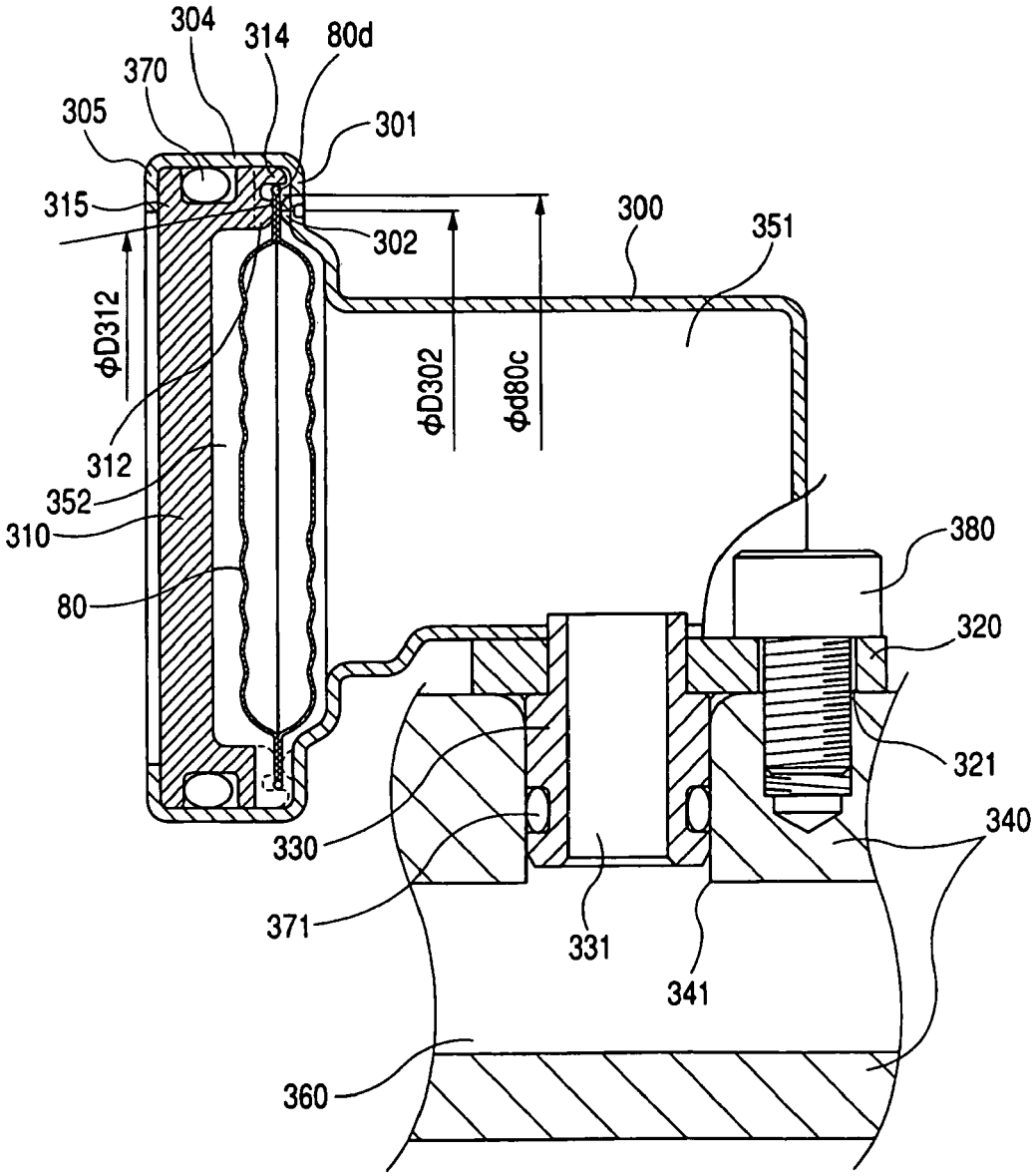
FIG. 6 is a general longitudinal sectional view of a first embodiment of a damper mechanism to which the present invention is applied.

Referring to FIG. 6, the operation of the pressure pulsation damping mechanism will be described below.

Figure 9:
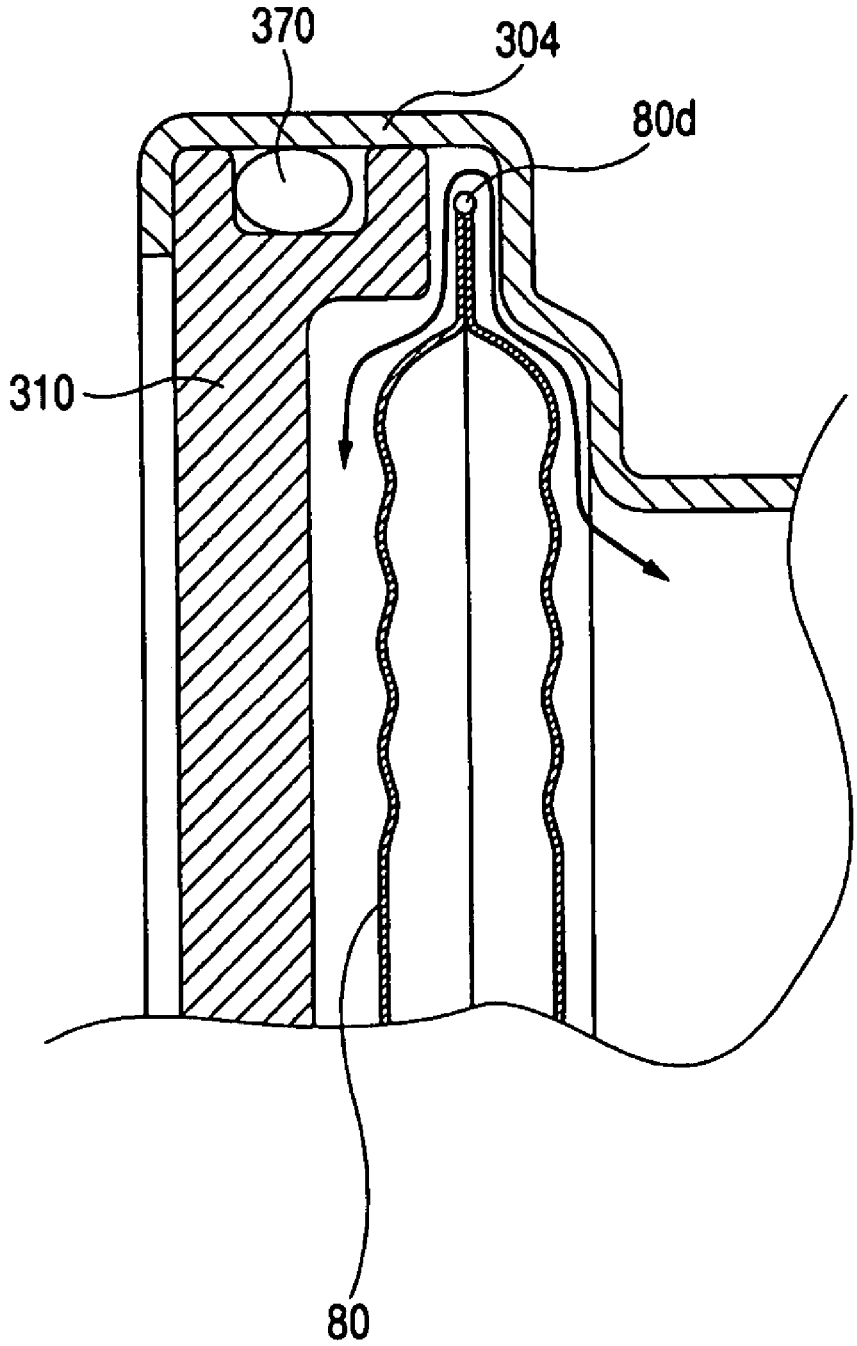
FIG. 9 is a partial enlarged view illustrating the flow of fuel.

The fluid whose pressure pulsation is to be damped, existing in the component 340, is guided into the first space 351 in the pressure pulsation damping mechanism through the connecting tube 330. The first space 351 connects to the second space 352. This connection is provided by: the passage 303 formed by the portions between the ark-shaped projections (cut portion of an annular projection) 302 of the casing; the gap between the rim of the double metal diaphragm damper and the casing; and the passage 313 formed by cutting the annular projection 312 of the cover (FIG. 9). When the pressure of the fluid whose pulsation is to be damped is increased, the pressure is transmitted to the first space 351 and the second space 352, and the double metal diaphragm damper 80 is deformed to reduce its volume. Thereby, the action of reducing the pressure is brought about. When the pressure of the fluid whose pulsation is to be damped is decreased, on the other hand, the double metal diaphragm damper 80 is deformed to increase its volume. Thereby, the action of suppressing reduction in the pressure is brought about.

The first space 351 and the second space 352 themselves provide the fluid with volume, and thus the spaces themselves have a pressure pulsation damping function. Pressure pulsation can be damped also by elastic deformation in the casing.

Figure 10:
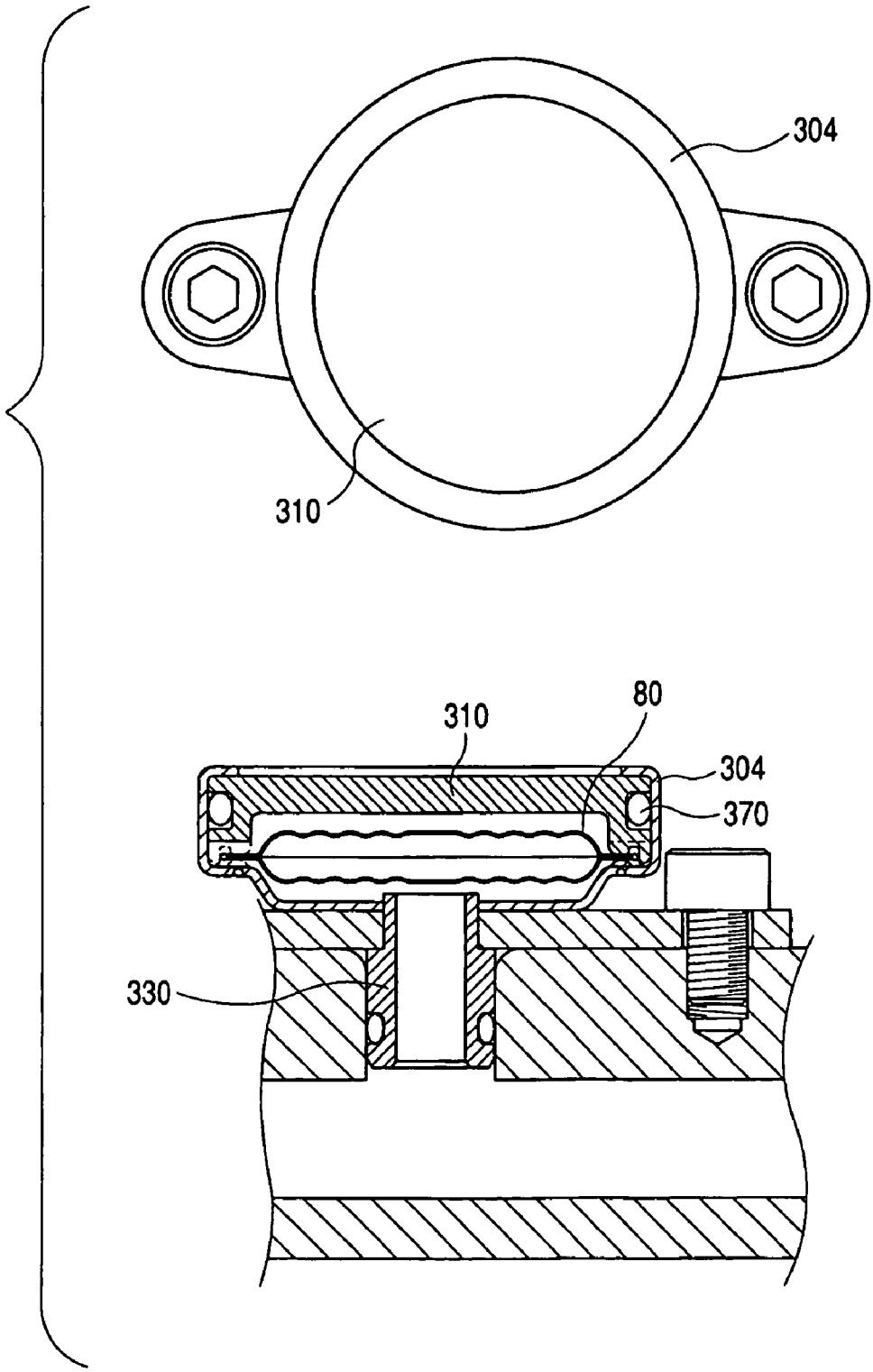
FIG. 10 is a general longitudinal sectional view of a second embodiment of a damper mechanism to which the present invention is applied.

FIG. 10 illustrates an example wherein the pressure pulsation damping mechanism is so constituted that the axis of the connecting tube 330 and the axis of the diaphragm 80 are parallel or coaxial.

Figure 11:
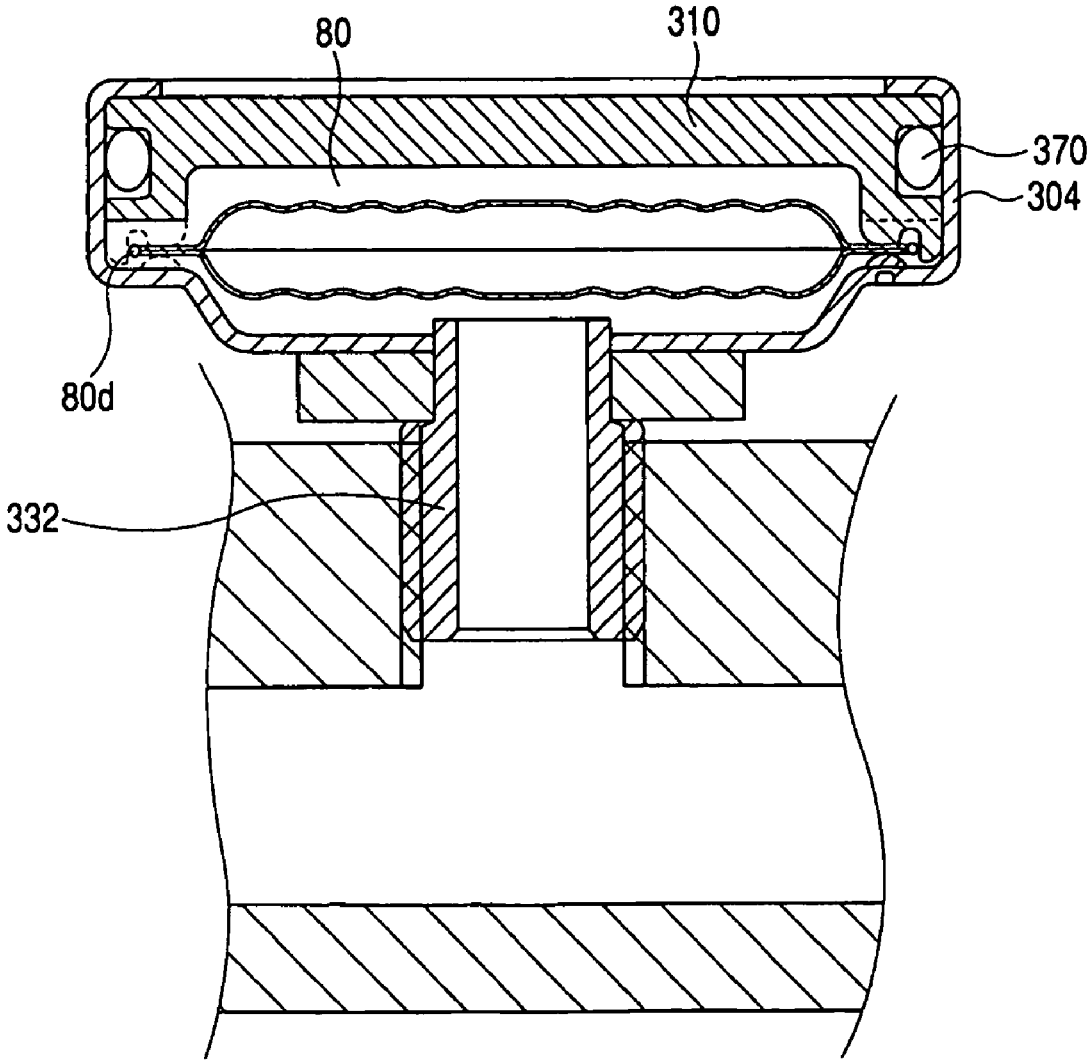
FIG. 11 is a general longitudinal sectional view of a third embodiment of a damper mechanism to which the present invention is applied.

FIG. 11 illustrates an example wherein the rim of the connecting tube is provided with screw structure 332 instead of using the fastening flange together with the connecting tube. The method for joining the pressure pulsation damping mechanism with the component in which the fluid whose pressure pulsation is to be damped exists is not limited to this screw structure. Any sealing method commonly used in piping connection may be used.

Figure 12:
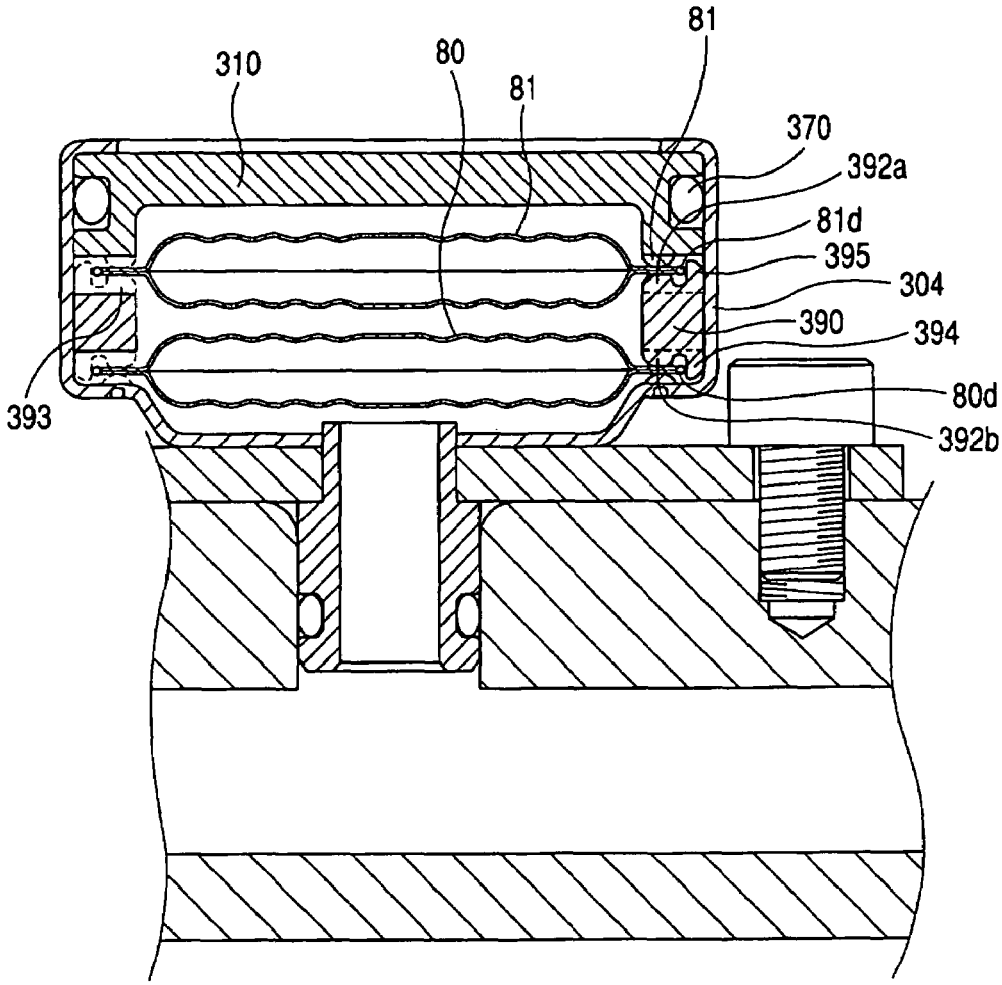
FIG. 12 is a general longitudinal sectional view of a fourth embodiment of a damper mechanism to which the present invention is applied.

FIG. 12 illustrates an example wherein two double metal diaphragms 80 and 81 are used. Based on the embodiment illustrated in FIG. 6, an annular member 390 is placed between the two double metal diaphragms. Thereby, installation of the two double metal diaphragms 80 is made feasible, and a third space 353 is formed.

Like the cover 310 in the embodiment in FIG. 6, the annular member 390 is installed inside the case 300, using the inner side face of the cylindrical portion 304as a guide. The annular member is coaxial with the cylindrical portion 304.

The annular member 390 has on both sides an annular projection 392 formed arc-shaped projections which support the double metal diaphragms 80 and 81. Like the annular projection (arc-shaped projections) 312 on the cover 310 in the embodiment in FIG. 6, the annular projection 392 are formed to such dimensions that they are free of the weld bead portions 80*d* and 81*d* of the double metal diaphragms 80 and 81.

Like the guide 314 of the cover 310 in the embodiment in FIG. 6, the annular member 390 is provided with guides 394 and 395 which limits the positions of the double metal diaphragms 80 and 81 in the radial direction. If the cover 310 is not provided with a guide, the annular member 390 may be provided with a guide 395.

Like the fluid passage portion 313 (FIG. 8) of the cover 310 in the embodiment in FIG. 6, the annular member 390 has fluid passages 393. These passages are for connecting the first space and the third space and for connecting the third space and the second space.

In the above-mentioned structure, two double metal diaphragms are used. As a result, the total amount of change in the volume of double metal diaphragms with respect to pressure change is simply doubled. Therefore, the pressure pulsation damping function can be more effectively implemented.

More annular members 390 may be used as required. In this case, three or more double metal diaphragms 80 can be installed, and thus the pressure pulsation damping function can be further effectively implemented.

Figure 13:
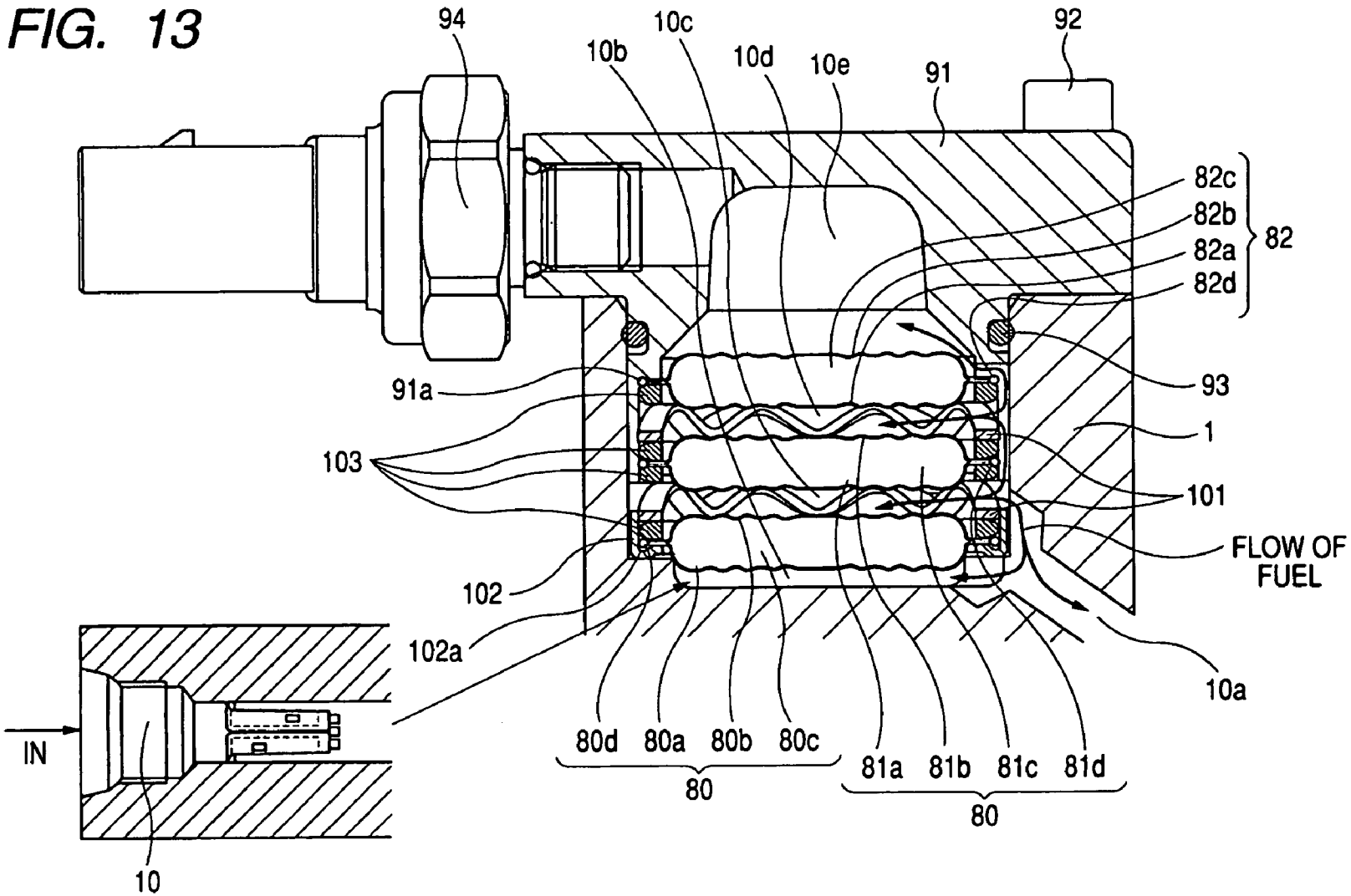
FIG. 13 is a general longitudinal sectional view of a pressure fuel pump in the fifth embodiment of the present invention.

FIG. 13 illustrates an example wherein three double metal diaphragms 80, 81, and 82 are used.

The three double metal diaphragm dampers 80, 81, and 82 are provided between the fuel passage 10 and the low pressure chamber 10*a*. Thus, fuel pressure pulsation can be further reduced.

The double metal diaphragm damper 80 has its rim clamped between the washer 103 and the washer guide 102 over the entire circumference. The washer 103 is provided with the same chamfers on outer diameter sides of its both sides. The washer 103 is machined so that its diameter is same as the diameter of the rim of the double metal diaphragm damper 80. The washer guide 102 is provided with the annular groove 102*a*. The fuel chambers 10*b* and 10*c* are connected to the fuel chamber 10*a*.

The double metal diaphragm damper 81 has its rim clamped between the two washers 103 over the entire circumference.

The double metal diaphragm damper 82 has its rim clamped between the washer 103 and the damper cover 91. The damper cover 91 is provided with the annular groove 91*a*. The portion in the damper cover 91 clamping the double metal diaphragm damper 82 is provided with a groove as a fuel passage.

Two spring washers 101 are provided among the three double metal diaphragm dampers 80, 81, and 82. Force for clamping the three double metal diaphragm dampers 80, 81, and 82 is produced by the damper cover 91 through the spring washers 101. The fuel is sealed from the outside by the O-ring 93.

Thus, the three double metal diaphragm dampers 80, 81 and 82 are guided by the same wall face as the washers 103. The peripheral weld 80*d* or 81*d* is not clamped. Therefore, the double metal diaphragm dampers 80, 81 and 82 are prevented from being damaged due to stress concentration.

The fuel can enter the fuel chamber 10*c* through the voids in the spring washers 101, and can enter the fuel chambers 10*d* and 10*e* through the groove formed in the damper cover 91. Therefore, the fuel can reach to both sides of the three double metal diaphragm dampers 80, 81, and 82, and fuel pressure pulsation can be absorbed with efficiency.

The washer 103 does not have distinction of the both sides. Thereby, mistake at the time of attachment of the washer can be prevented, and the assembly of parts can be improved.

Further, as mentioned above, three double metal diaphragm dampers are provided. Therefore, a high pressure fuel pump wherein the weight and size can be reduced and yet fuel pressure pulsation can be sufficiently absorbed is obtained.

According to the embodiments described above, a high pressure fuel pump wherein fuel pressure pulsation is efficiently absorbed and the fuel can be supplied to fuel injection valves under stable fuel pressure is obtained. This is performed by welding together the peripheral portions of two metal diaphragms with gas sealed between them to form a double metal diaphragm damper and appropriately securing the damper.

Further, a plurality of double metal diaphragm dampers may be appropriately secured. Thus, fuel pressure pulsation can be more easily and efficiently absorbed, and the fuel can be supplied to fuel injection valves under stable fuel pressure.

Mores specific description will be given. When a double metal diaphragm damper is used as a mechanism to reduce fuel pressure pulsation, a problem can arise. If the damper is secured by clamping a weld, stress concentration takes place at the weld, and the weld can be peeled off. In the above-mentioned embodiments, the whole or part of the portion inside the weld is clamped by annular ring or corrugated leaf spring to receive force for securing. As a result, the weld is prevented from being peeled off. In addition, the fuel can be distributed to both sides of the double metal diaphragm damper.

Further, if a plurality of metal diaphragm assemblies (double metal diaphragm dampers) are used, an annular ring or a corrugated leaf spring as retaining member is shared between two adjacent sets of metal diaphragm assemblies. As a result, the number of components can be reduced.

Thus, the metal diaphragm assembly (also referred to as "double metal diaphragm damper") reduces pressure pulsation in low pressure fuel. Therefore, the fuel can be supplied to fuel injection valves under stable fuel pressure.

What is claimed is:

1. A high pressure fuel pump comprising:

a plunger being arranged for reciprocating motion, a pressure chamber for pressurizing fuel in collaboration with reciprocating motion of the plunger, which pumps the fuel in the pressure chamber, an intake valve at an inlet port of the pressure chamber, a delivery valve at an outlet port of the pressure chamber, a pump body housing the pressure chamber, plunger, intake valve and delivery valve, a low pressure fuel passage positioned upstream from the intake valve in the pump body, a damper housing portion located along the low pressure fuel passage, a damper installed in the damper housing portion comprising at least one double metal diaphragm type damper in which two rim-welded metal diaphragms form a sealed space between there with a gas in the sealed space, such that fuel pressure pulsation caused by the reciprocating motion of the plunger exerts on the both sides of the double metal diaphragm-type damper, and a guide for limiting a radial position of the double metal-type diaphragm, which guide has a retaining portion formed with an shelf annular located at a side of a welded rim portion of the two metal diaphragms, such that the annular shelf presses completely around a circumference portion of the diaphragm, which portion is located radially inwardly of the welded rim portion.

2. The high pressure fuel pump according to claim 1, wherein the damper housing portion is arranged in the pump body so as to be across a partition wall from the pressure chamber, and the double metal diaphragm-type damper faces a head of the plunger with the partition wall in-between.

3. The high pressure fuel pump according to claim 1, wherein a solenoid drive type engaging member for controlling an operation timing of the intake valve is provided in an intake chamber between the damper housing portion and the pressure chamber.

4. The high pressure fuel pump according to claim 1, wherein a pair of the at least one double metal diaphragm-type damper is spaced in the damper housing portion by a spring washer or a spring placed between the pair of dampers.

5. The high pressure fuel pump according to claim 1, wherein the pump body includes a fuel pressure sensor for sensing fuel pressure of the low pressure fuel passage.

6. The high pressure fuel pump according to claim 1, where the guide has a cylindrical portion guided by an inner surface of the damper housing portion.

* * * * *